US008047249B2

(12) United States Patent
Iwasaki et al.

(10) Patent No.: US 8,047,249 B2
(45) Date of Patent: Nov. 1, 2011

(54) STRIP PACK APPARATUS

(75) Inventors: Yoshio Iwasaki, Shiga (JP); Akira Yamamoto, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 194 days.

(21) Appl. No.: 12/447,167

(22) PCT Filed: Oct. 3, 2007

(86) PCT No.: PCT/JP2007/069386

§ 371 (c)(1),
(2), (4) Date: Apr. 24, 2009

(87) PCT Pub. No.: WO2008/050593

PCT Pub. Date: May 2, 2008

(65) Prior Publication Data

US 2010/0024988 A1 Feb. 4, 2010

(30) Foreign Application Priority Data

Oct. 25, 2006 (JP) ..... 2006-289937

(51) Int. Cl.
*B32B 39/00* (2006.01)

(52) U.S. Cl. ..... 156/362; 156/552; 156/556; 53/136.1

(58) Field of Classification Search ..... 156/362, 156/556, 538, 552; 53/136.1, 135.1
See application file for complete search history.

(56) References Cited

U.S. PATENT DOCUMENTS

| | | | | |
|---|---|---|---|---|
| 3,465,411 | A * | 9/1969 | Mahnken | 493/6 |
| 3,864,895 | A | 2/1975 | Petrea | |
| 4,476,619 | A * | 10/1984 | Palmer | 29/429 |
| 5,390,475 | A * | 2/1995 | Iwauchi et al. | 53/474 |
| 6,726,794 | B2 * | 4/2004 | Belt | 156/265 |
| 7,093,404 | B2 * | 8/2006 | Kubo et al. | 53/136.1 |

FOREIGN PATENT DOCUMENTS

| | | | |
|---|---|---|---|
| JP | H11-011442 | A | 1/1999 |
| JP | 2004-182302 | A | 7/2004 |
| JP | 2005-162270 | A | 6/2005 |

* cited by examiner

*Primary Examiner* — Katarzyna Wyrozebski Lee
*Assistant Examiner* — John Blades
(74) *Attorney, Agent, or Firm* — Global IP Counselors, LLP

(57) ABSTRACT

A strip pack apparatus is an apparatus for manufacturing a strip pack with a plurality of items attached on a backing sheet. The strip pack apparatus includes a conveying unit configured and arranged to convey the item generally in the horizontal direction, a moving unit configured and arranged to move the item from the conveying unit to a position obliquely downward on the front side in the conveying direction, and an attaching unit configured and arranged to attach the item moved by the moving unit to the backing sheet.

1 Claim, 10 Drawing Sheets

STRIP PACK APPARATUS

CROSS-REFERENCE TO RELATED APPLICATIONS

This national phase application claims priority to Japanese Patent Application No. 2006-289937 filed on Oct. 25, 2006. The entire disclosure of Japanese Patent Application No. 2006-289937 is hereby incorporated herein by reference.

TECHNICAL FIELD

The present invention is in the technical field of manufacturing a product called strip pack, in which a plurality of items is adhered to a backing sheet and displayed in a state of being suspended.

BACKGROUND ART

As is conventional, products in which a plurality of items, which snacks and the like are filled in a bag, are adhered to a backing sheet in a strip and the like, are known. This kind of a product is displayed in retail stores and so forth in a suspended state with a portion of the backing sheet being held in place, and is referred to as strip pack (meaning a packaging configuration in which an item can be taken by pulling it off) since consumers take each individual item by pulling it off from the backing sheet. This strip pack has an advantage of increasing consumers' eagerness to buy, and can promote diversity in the design and space saving of the display.

A strip pack apparatus for manufacturing this kind of strip pack includes, for example, the apparatus described in Japanese Patent Laid-Open Publication No. 2004-182302, which is arranged directly below a vertical bag-making packaging machine, in which after an item manufactured at the packaging machine is moved by a left and right pair of grasping arms grasping the item at the upper two sides thereof to the adhering position below, the item is adhered to the backing sheet at the upper end portion thereof. In addition, the apparatus described in U.S. Pat. No. 3,864,895 is also arranged directly below a vertical bag-making packaging machine, and after an item manufactured at the packaging machine is grasped and held at the upper single surface thereof by a suction cup and moved to the adhering position in front, the item is adhered to the backing sheet at the upper end portion thereof.

DISCLOSURE OF THE INVENTION

Meanwhile, the strip pack apparatuses described in the above mentioned publications are directly connected to the vertical bag-making packaging machine arranged immediate above it, and thus, only an item manufactured at this packaging machine can be made into a strip pack. In addition, a quality check on the weight, seal quality, and the like cannot be done before the item manufactured at this packaging machine is made into a strip pack. Consequently, it is desirable to propose a highly versatile strip pack apparatus that is configured to be independent from the devices on the upstream side and downstream side. The basic configuration of this kind of a strip pack apparatus includes a conveying unit for conveying an item roughly in the horizontal direction, a moving unit for moving the item conveyed by this conveying unit to an attaching position, and an attaching unit for attaching the item moved by this moving unit to a backing sheet.

In that case, a problem arises of where to arrange the attaching position with respect to the conveying unit. If the attaching position is arranged above the conveying unit, the moving unit will have to move the item up, which is not commonly done. If the attaching position is arranged to the side of the conveying unit, the item will have to be moved to the side, and the width of the strip pack apparatus increases, which deteriorates the layout ability thereof. In that respect, if the attaching position is arranged below the conveying unit, it is only necessary for the moving unit to move the item downward, and in addition, this does not increase the width of the strip pack apparatus. However, a problem occurs when the attaching position is arranged directly below the conveying unit. In order to move the item to the attaching position that is directly below it, it becomes necessary to have a configuration for removing the conveying unit since the conveying unit will be in the way, and so mechanisms and operations for doing so will be complicated, and the speed cannot be increased.

Consequently, the present invention has an object of improving the disposition of the attaching position with respect to the conveying unit, in a highly versatile strip pack apparatus configured independently from the devices on the upstream side and downstream side thereof, so that an item does not have to be moved up by the moving unit, and the width of the strip pack apparatus does not increase, and also, the mechanisms and operations for moving an item to the attaching position do not become complicated.

The strip pack apparatus, for manufacturing a product with a plurality of items attached on a backing sheet, according to a first aspect of the present invention for achieving the above described object includes a conveying unit configured and arranged to convey an item generally in the horizontal direction, a moving unit configured and arranged to move the item from the conveying unit to a position obliquely downward on the front side in the conveying direction, and an attaching unit configured and arranged to attach the item moved by the moving unit to the backing sheet.

The strip pack apparatus according to a second aspect of the present invention is the strip pack apparatus as set forth in the first aspect, wherein the moving unit is configured and arranged to grasp an end portion on the front side in the conveying direction of the item conveyed by the conveying unit, and to move the item to the position obliquely downward on the front side in the conveying direction, and the attaching unit is configured and arranged to attach the item to the backing sheet at the end portion grasped by the moving unit.

The strip pack apparatus according to a third aspect of the present invention is the strip pack apparatus as set forth in the first or the second aspect, wherein the conveying unit is configured and arranged to convey the item to a terminal portion of the conveying unit, and the terminal portion of the conveying unit is configured and arranged to be tilted so that the front side of the terminal portion in the conveying direction becomes lower than the rear side of the terminal portion in the conveying direction when the item is moved by the moving unit.

With the strip pack apparatus according to the first aspect of the present invention, since the strip pack apparatus does not move the item conveyed by the conveying unit directly below from the conveying unit, but moves the item obliquely downward on the front side in the conveying direction from the conveying unit, in other words, since the attaching position is arranged in a position slanting downward on the front side in the conveying direction with respect to the conveying unit, the item does not have to be moved up by the moving unit like when the attaching position is arranged above the conveying unit, and the width of the strip pack apparatus does not increase like when the attaching position is arranged to the side of the conveying unit, and also, the mechanisms and operations for moving the item to the attaching position do not become complicated like when the attaching position is arranged directly below the conveying unit. In other words, when the item is moved obliquely downward on the front side in the conveying direction from the conveying unit, the item can be moved to the attaching position without having to go through the trouble of removing the conveying unit, and as a result, the speed of the strip pack apparatus can be increased.

With the strip pack apparatus according to the second aspect of the present invention, since the moving unit for moving the item to the attaching position is also used as the grasp member for holding the item, the configuration of the strip pack apparatus is simplified. In addition, in this case, the moving unit, which is the grasp member, holds the end portion of the item to be attached to the backing sheet, and thus, the end portion is kept to be flat. As a result, the end portion overlaps favorably with the backing sheet, and the item is attached to the backing sheet in a favorable state.

With the strip pack apparatus according to the third aspect of the present invention, since the terminal portion of the conveying unit is tilted so that the front side in the conveying direction becomes lower, the item is moved smoothly obliquely downward, and this prevents a big impact from acting on the item when it is being moved.

The objects, characteristics, aspects, and advantages of this invention will become even more clear with the detailed description below and the attached drawings.

BRIEF DESCRIPTION OF THE DRAWINGS

FIG. 3(*b*) is a plan view showing a strip pack manufactured by the strip pack apparatus;

FIG. 6(*b*) is a side view showing the state after the seal portion of a bag is grasped by the grasp unit;

BEST MODE FOR CARRYING OUT THE INVENTION

Figure 1:
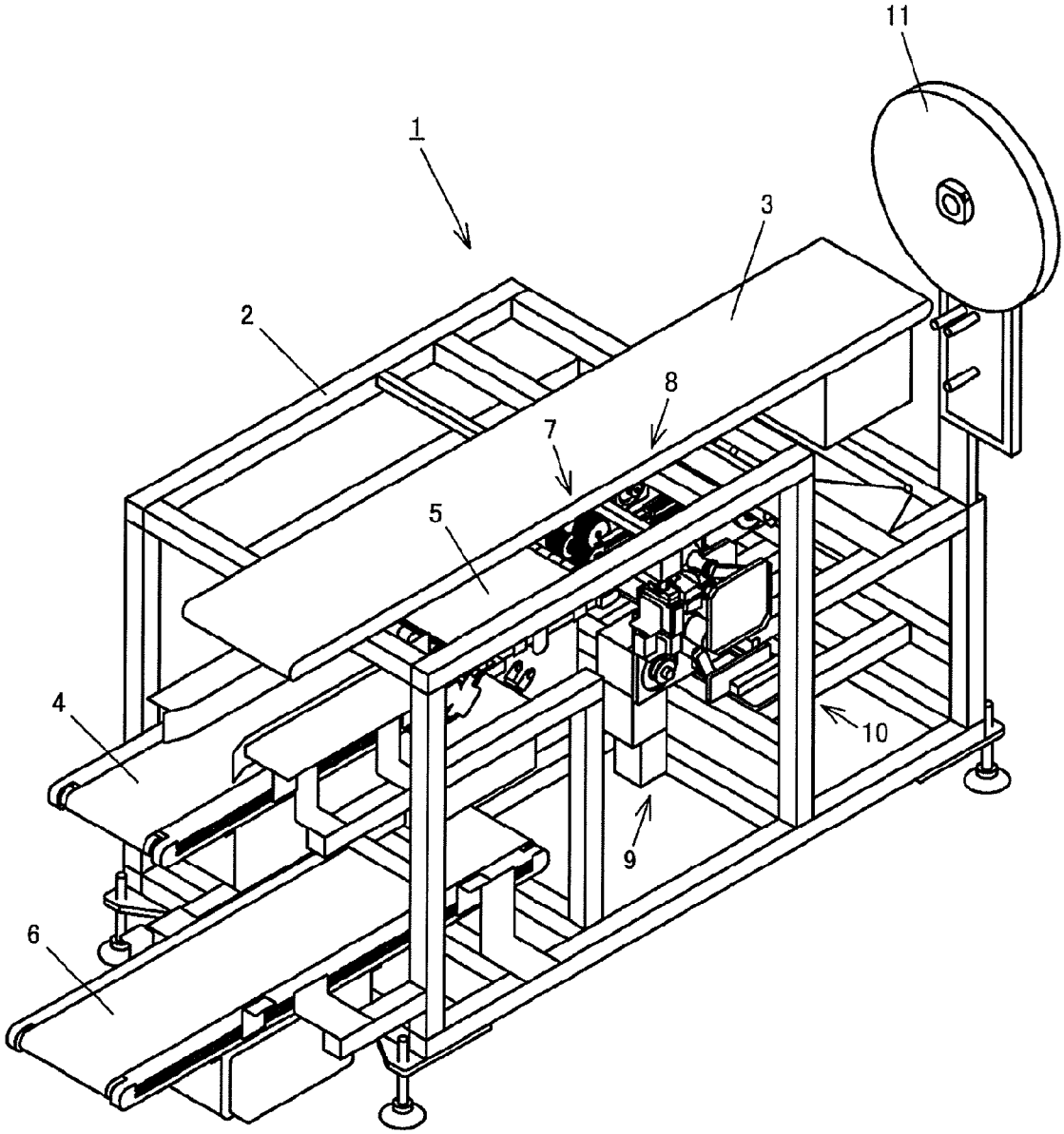
FIG. 1 is a perspective view showing a strip pack apparatus according to an embodiment of the present invention.
Figure 2:
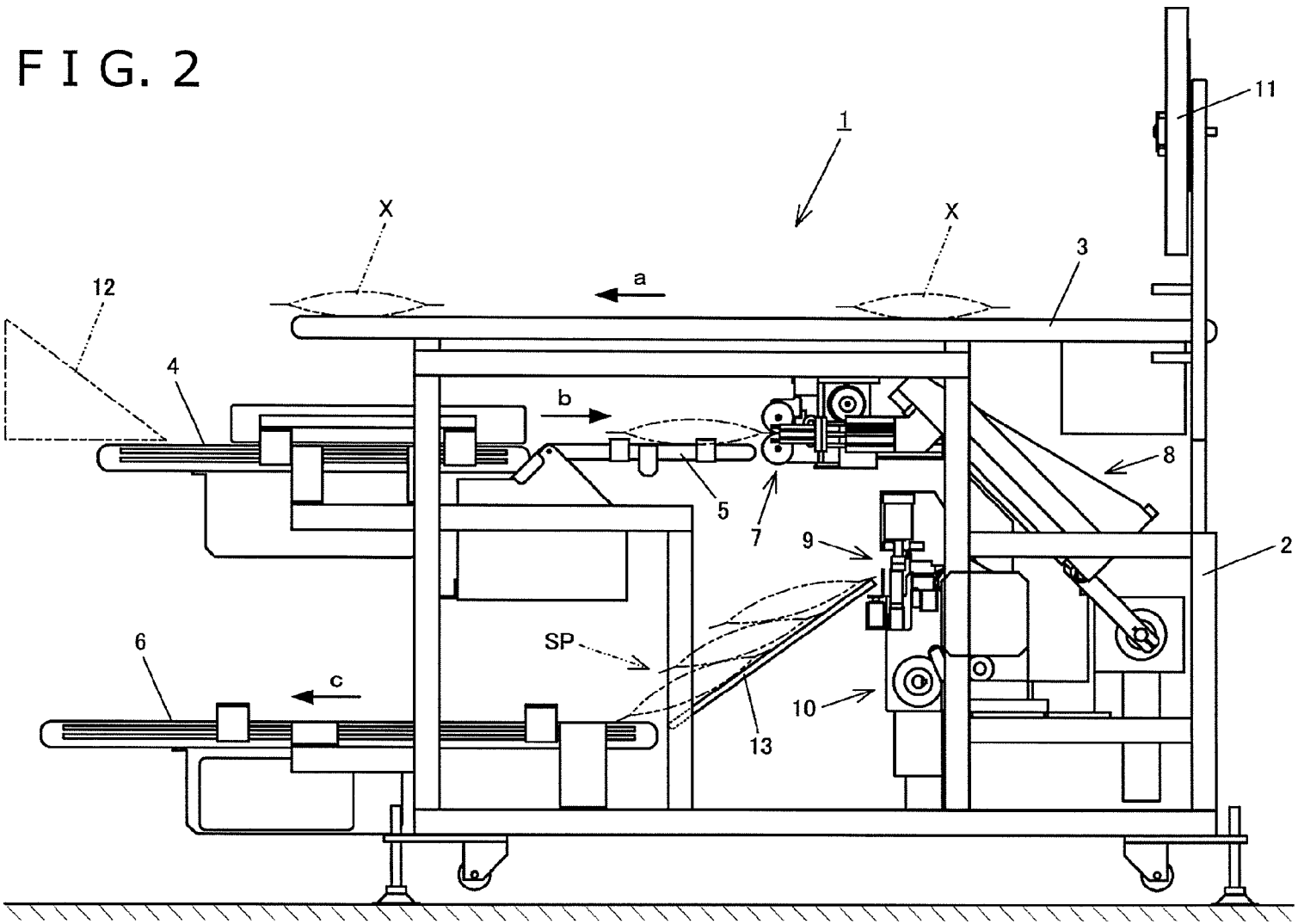
FIG. 2 is a side view showing the strip pack apparatus.
Figure 4:
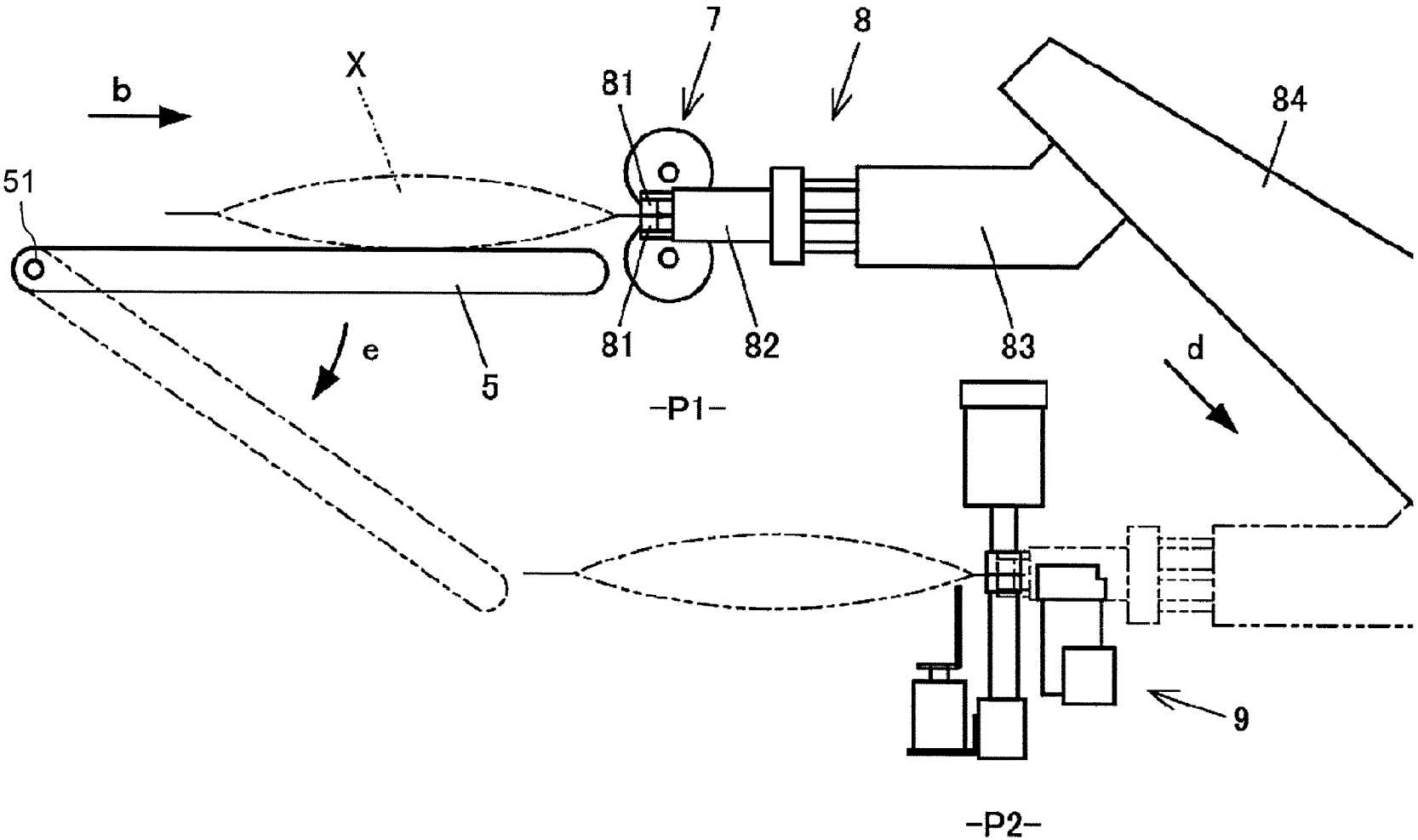
FIG. 4 is a side view showing the positional relationship between a grasp position and an attaching position in the strip pack apparatus.

FIGS. 1 and 2 show a perspective view and a side view respectively, conceptually showing a strip pack apparatus 1 according to an embodiment of the present invention. FIG. 4 shows the flow of a series of processes, from a process of guiding a packaged item (bag X) to the interior of the strip pack apparatus 1, to a process of attaching the packaged item to a tape T.

Figure 3A:
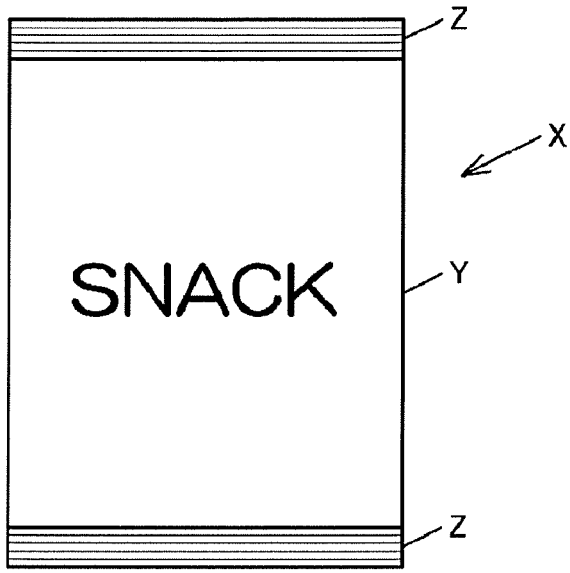
FIG. 3(*a*) is a plan view showing a bag to be supplied to the strip pack apparatus.
Figure 3B:
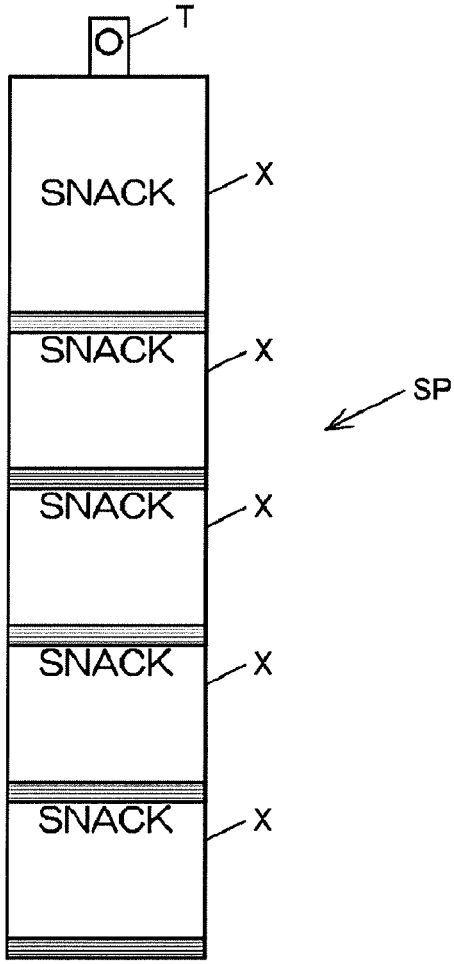

FIGS. 3(*a*) and 3(*b*) show the packaged item (bag X) and the strip pack SP, respectively. The bag X has a hollow portion Y in which snacks and the like are filled, and two seal portions Z at the top and bottom (FIG. 3(*a*)). In addition, the top seal portion Z refers to the side of the seal portion Z on which the letters "SNACK" written on the bag can be read from a normal viewpoint, when one of the two seal portions Z is picked and lifted up.

In the strip pack SP, a predetermined number of bags X are aligned and attached on the tape T (FIG. 3(*b*)). The top seal portions Z of the bags X are attached to the tape T. A hole punched is provided on a portion near an end of the tape T for allowing the strip pack SP to be displayed suspended.

Brief Overview of Strip Pack Apparatus 1

The strip pack apparatus 1 having great versatility is an apparatus for manufacturing strip packs SP, and is independent from both the devices on the upstream and downstream sides. Furthermore, a packaging unit and the like for filling articles into the bags X through automatic packaging are included in the device on the upstream side. A device and the like for putting the strip packs SP into a box are included in the device on the downstream side.

Specifically, the strip pack apparatus 1 includes a body unit 2, a supply conveyor 3, a lead-in conveyor 4, a drop conveyor 5, a discharge conveyor 6, a brush unit 7, a grasp unit 8, an attaching unit 9, and a tape feeding unit 10.

The supply conveyor 3, the lead-in conveyor 4, the drop conveyor 5, the discharge conveyor 6, the brush unit 7, the grasp unit 8, the attaching unit 9, and the tape feeding unit 10 are supported by the body unit 2.

Each device will be described in detail below.

Supply Conveyor 3

The supply conveyor 3 supplies the bags X produced at the device on the upstream side to the strip pack apparatus 1. More specifically, the supply conveyor 3 is arranged outside the strip pack apparatus 1, and conveys the bags X in the direction roughly horizontal, and in the direction of arrow a (FIG. 2).

Lead-in Conveyor 4

The lead-in conveyor 4 guides the bags X supplied by the supply conveyor 3 to the interior of the strip pack apparatus 1. More specifically, the lead-in conveyor 4 conveys the bags X in a direction roughly horizontal, and in the direction of arrow b (FIG. 2). At this time, the bags X are conveyed in the direction of arrow b with the top seal portions Z to the front. The arrow b direction is the opposite direction from the arrow a direction.

The lead-in conveyor 4 can be comprehended to be the conveying unit for conveying bags X roughly in the horizontal direction, in view of the lead-in conveyor 4 conveying bags X roughly in the horizontal direction. In addition, the arrow b direction can be comprehended as the conveying direction.

A member 12 is arranged on the starting end portion side of the lead-in conveyor 4 that conveys the bags X in the arrow b direction (FIG. 2). The member 12 prevents the bags X, dropped from the supply conveyor 3, from not being entered into the strip pack apparatus 1. Furthermore, the member 12 is omitted in FIG. 1.

Drop Conveyor 5

The drop conveyor 5 is positioned on the terminal portion side of the lead-in conveyor 4, and guides the bags X conveyed by the lead-in conveyor 4 to the brush unit 7. In addition, the conveying unit described above can include the drop conveyor 5. When this is the case, the drop conveyor 5 can be comprehended to be the terminal portion of the conveying unit.

As shown in FIG. 4, the drop conveyor 5 can move in the arrow e direction with a fulcrum 51 as the center thereof. The drop conveyor 5 tilts with the movement thereof in the arrow e direction.

The movement of the drop conveyor 5 is linked to the movement of the grasp unit 8. This is described in detail in "Grasp Unit 8".

Brush Unit 7

The brush unit 7 undoes the wrinkles on the top seal portions Z of the bags X being conveyed thereto by the drop conveyor 5. Details will be described using FIG. 5.

Figure 5:
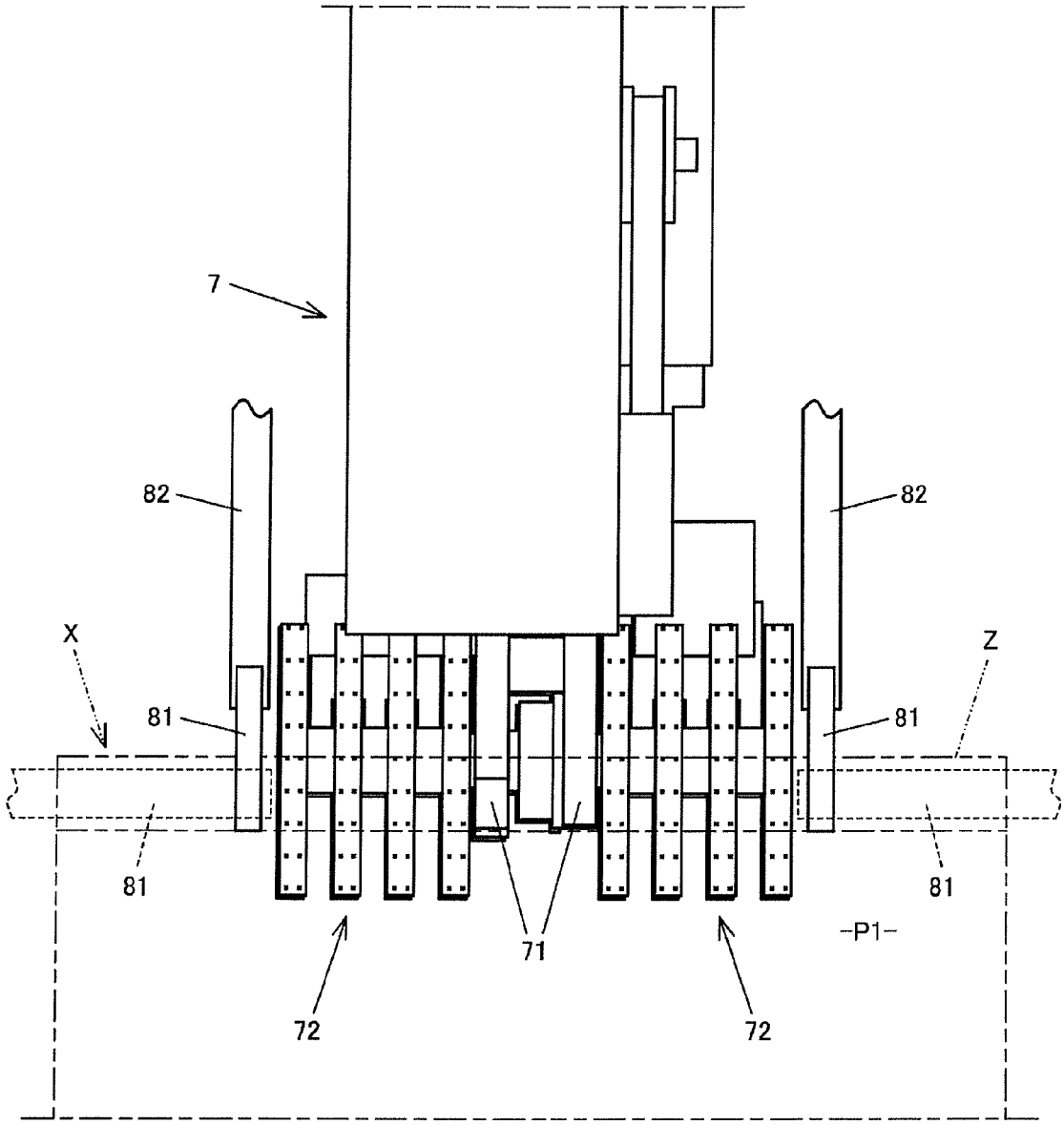
FIG. 5 is a plan view showing the state when dewrinkling a seal portion of a bag by a brush unit, and when the seal portion is being held by a grasp unit in the strip pack apparatus.

FIG. 5 is a diagram of the brush unit 7 viewed from above. The brush unit 7 is arranged on the distant side of the arrow b with respect to the drop conveyor 5 (FIG. 4), and includes two of each of the brushes 72 and supporting members 71. In addition, only the upper brush 72 and the supporting member 71 for supporting the upper brush 72 are shown in FIG. 5.

The brushes 72 undo wrinkles on the seal portions Z of bags X. More specifically, the brush unit 7 includes two brushes 72 for sandwiching the seal portion Z from the upper side and the lower side. With both the upper and the lower brushes 72, a plurality of thin disk-shaped separated brushes is arranged side by side at predetermined intervals. Spongious brushes (rollers), brushes like scrubbing brushes with wire rods tied together radially, and the like, can be adopted for the brushes 72.

The upper brush 72 rotates from the base portion side to the edge portion side of the seal portion Z, in the state of being in contact with the upper surface of the seal portion Z. The lower brush 72 rotates from the base portion side to the edge portion side of the seal portion Z, in the state of being in contact with the undersurface of the seal portion Z. By doing so, the top seal portion Z is dewrinkled by being stroked by the upper and lower two brushes 72.

In addition, the upper and lower brushes 72 are supported by the supporting members 71 arranged one at the top and one at the bottom, respectively.

Grasp Unit 8

Figure 6A:
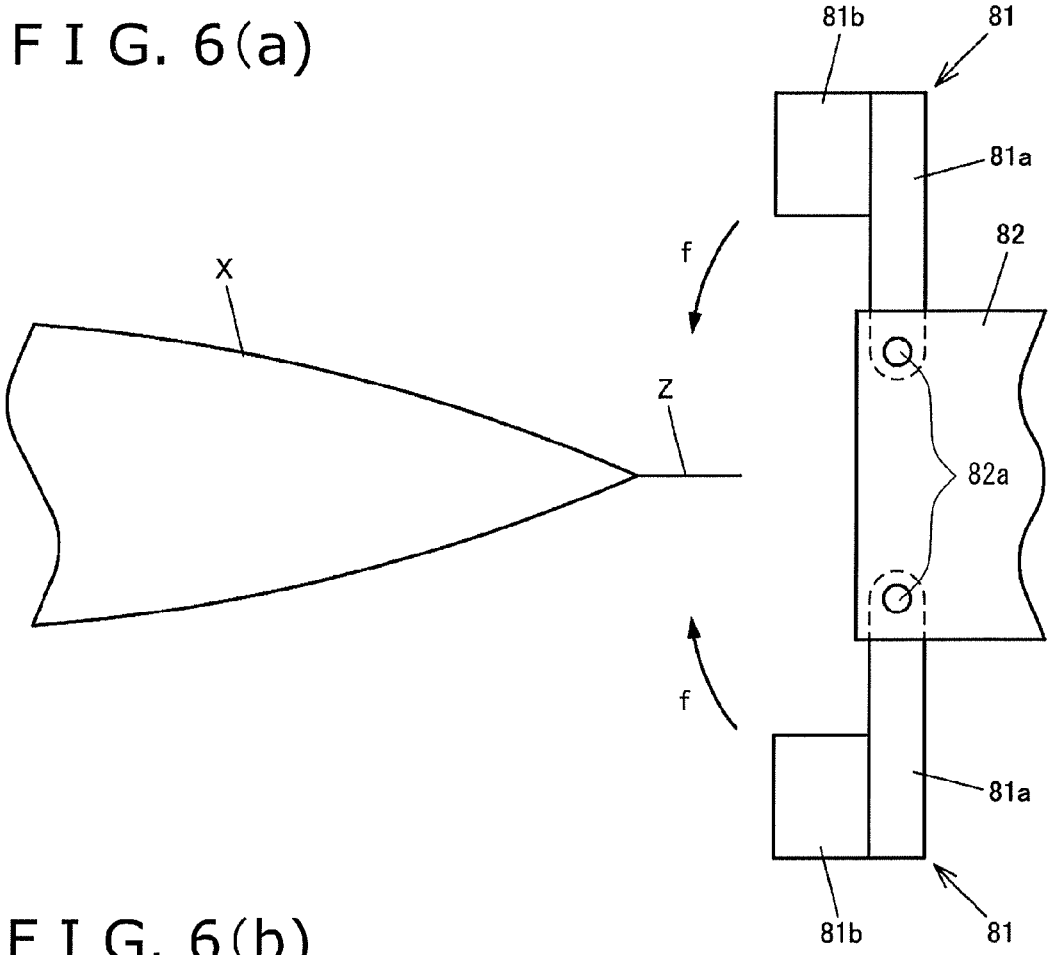
FIG. 6(*a*) is a side view showing the state before the seal portion of a bag is grasped by the grasp unit.
Figure 6B:
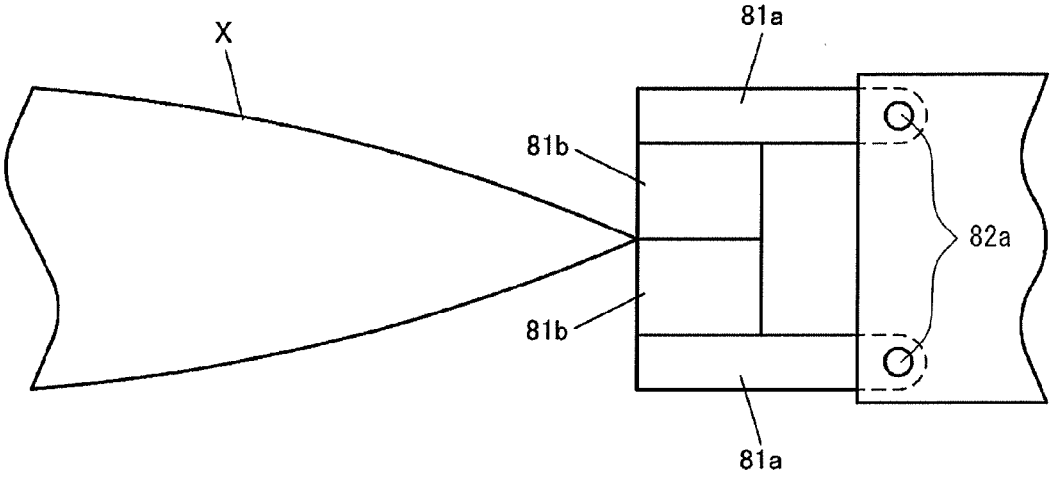

FIG. 6 shows the grasp unit 8 viewed from the side. The configuration and the operation of the grasp unit 8 and the positional relationship thereof with the brush unit 7 will be described below using FIGS. 6 and 4.

Configuration of Grasp Unit 8

The grasp unit 8 grasps the top seal portions Z of the bags X dewrinkled by the brush unit 7 from the top seal portion Z side (distant side of arrow b) with respect to the bags X. More specifically, the grasp unit 8 is arranged on the distant side of the arrow b with respect to the drop conveyor 5, and includes a pair of grip fingers 81, hands 82, arms 83, and guide rails 84 (FIG. 4).

The pair of grip fingers 81 is arranged one on the upper side and the other on the lower side, and can grasp the seal portions Z by sandwiching the seal portions Z from above and below. This pair of grip fingers 81 each includes a finger body 81*a* and a grasp portion 81*b*. The finger bodies 81*a* can move (pivot) in the arrow f direction (FIG. 6), with fulcrums 82*a* provided on the hand 82 as the centers thereof.

The grasp portions 81*b* are mounted on the tip of the finger bodies 81*a*. Rubber and the like, having elasticity, is adopted for the grasp portions 81*b*. By doing so, it becomes easier to grasp the seal portions Z, and as a result, it can prevent the seal portions Z from falling off from between the upper and lower grasp portions 81*b* after being grasped.

The hands 82 are supported on the arms 83, and are both equipped with the pair of grip fingers 81 (FIG. 4). The hands 82 can adjust the positions thereof relative to the arms 83. The arms 83 can move along the tilted guide rails 84.

(Positional Relationship with the Brush Unit 7)

On the two sides of the brush unit 7 are each of the grip fingers 81, and the hands 82 as well, for these grip fingers 81 (FIG. 5).

The grip fingers 81, one on each side, on both sides of the brush unit 7 grasps the seal portions Z longitudinally at the two sides of the brushes 72. Consequently, wrinkles on the portion of the seal portions Z between the two grip fingers 81 are undone by the brush unit 7.

Operation of Grasp Unit 8

The grasp unit 8 holds the seal portions Z after the seal portions Z have been dewrinkled by the brush unit 7 at position (grasp position) P1 near the terminal portion of the drop conveyor 5.

After that, the grasp unit 8 moves in the arrow d (FIG. 4) direction, more specifically, on distant side (front side) of arrow b (FIG. 4), and to the direction slanting downward (obliquely downward). As a result, the bag X being grasped moves to the attaching unit 9, more specifically, to position (attaching position) P2.

When moving the bag X in the arrow d direction, the drop conveyor 5 moves in the arrow e (FIG. 4) direction, and tilts.

The grasp unit 8 holds the bag X conveyed thereto by the lead-in conveyor 4, and moves this bag X, while holding the bag X, to the front side of arrow b, and to the direction slanting downward. In view of this, the grasp unit 8 can be comprehended in the following way. In other words, the grasp unit 8 can be comprehended to be the grasp member for holding bags X, and can be comprehended to be the moving unit for moving the bag X conveyed by the lead-in conveyor (conveying unit) 4 from the lead-in conveyor 4 obliquely downward on the front side of the arrow b direction (conveying direction).

Attaching Unit 9

Configuration of Attaching Unit 9

The attaching unit 9 attaches the top seal portion Z of the bag X held by the grasp unit 8 to the tape T. In addition, the attaching unit 8 can be comprehended to be the attaching unit for attaching bags X to the tape T. The details will be described using FIGS. 7 and 8.

Figure 7:
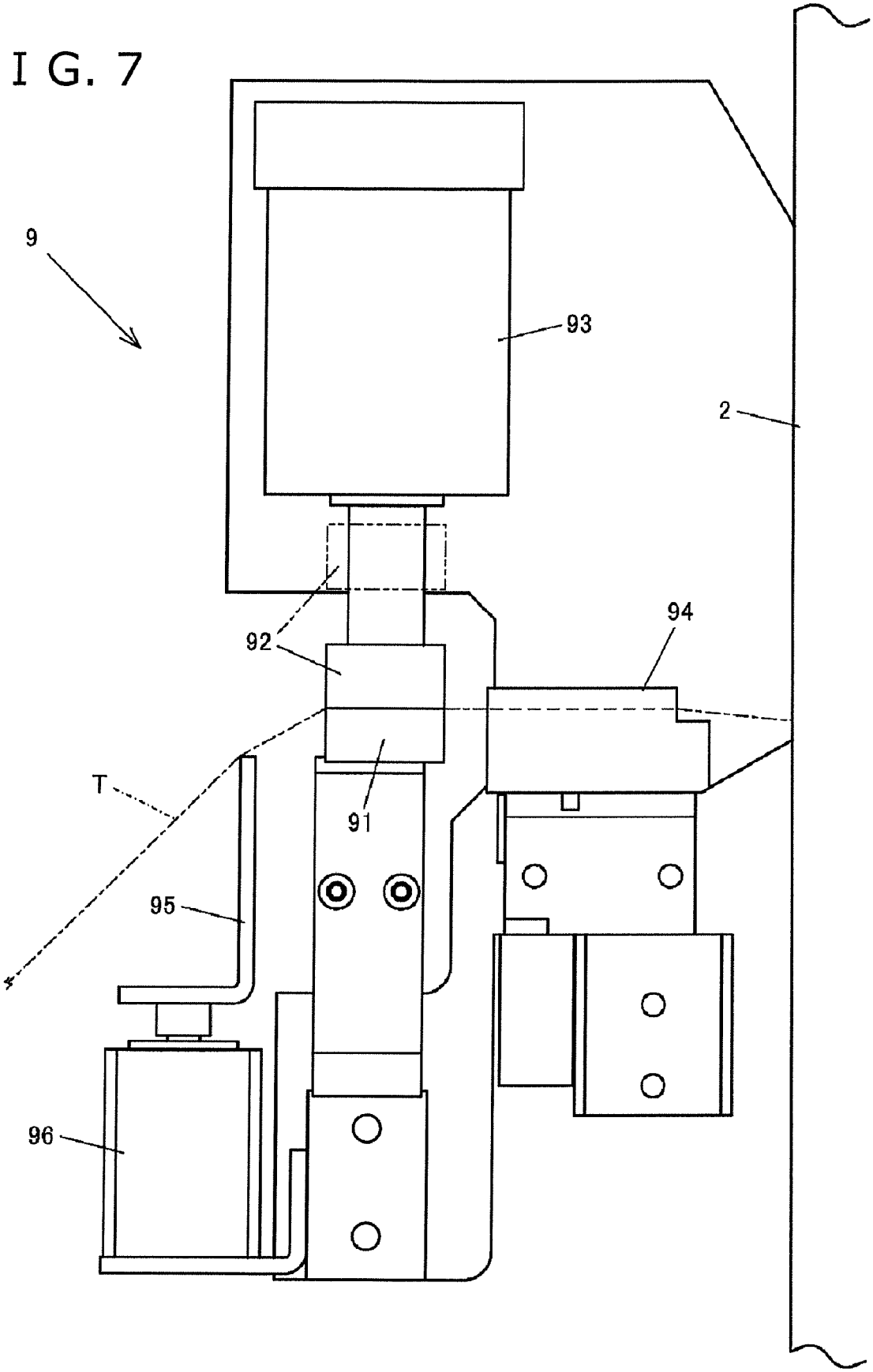
FIG. 7 is a side view showing an attaching unit of the strip pack apparatus.
Figure 8:
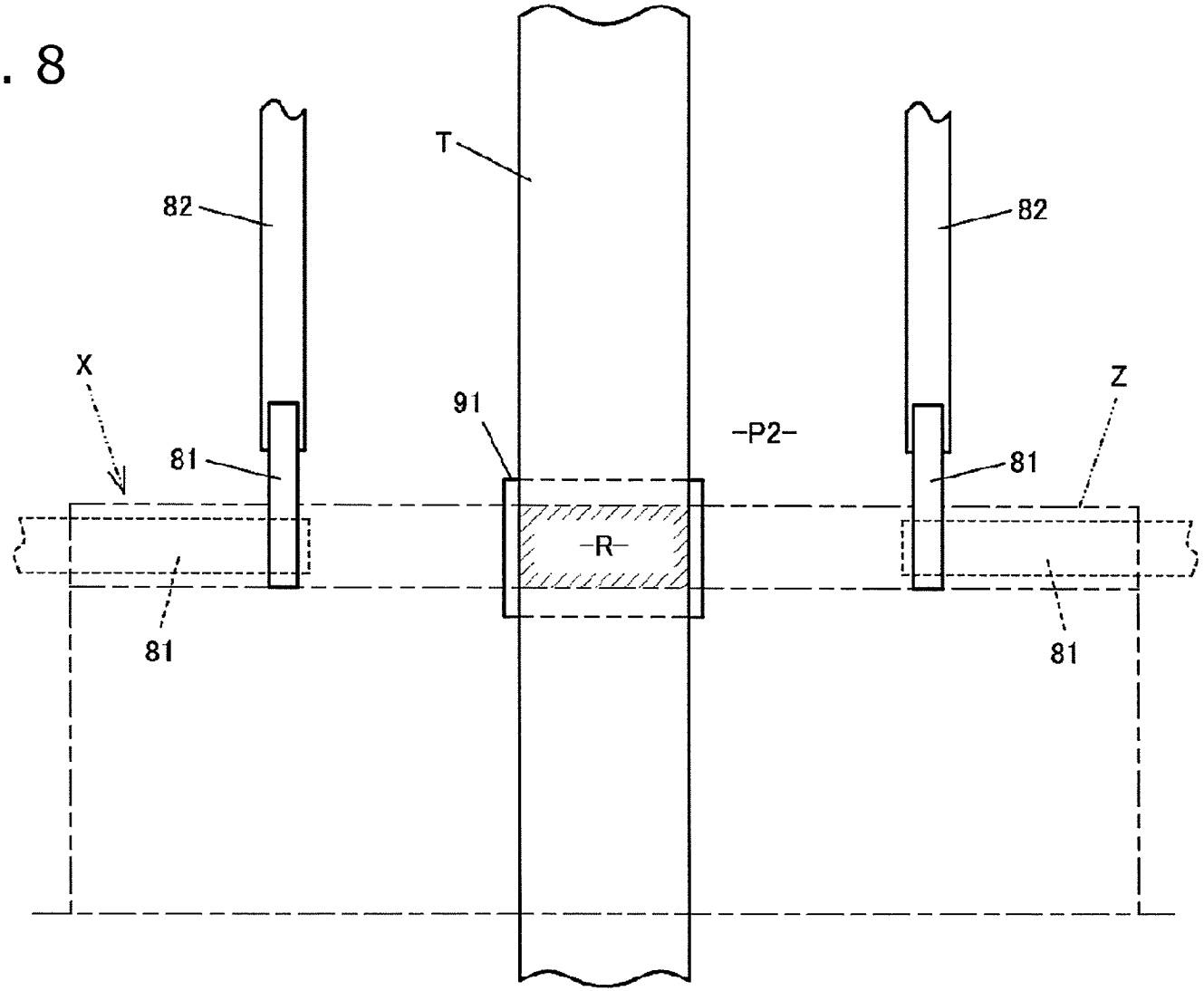
FIG. 8 is a plan view showing the state when attaching a bag to a tape.

FIG. 7 is a diagram of the attaching unit 9 viewed from the side. FIG. 8 is a diagram of the attaching unit 9 viewed from above. The attaching unit 9 includes a heater 91, a clamp 92, a clamp air cylinder 93, a punch/cutter unit 94, a melting prevention member 95, and an air cylinder 96. The heater 91 is the source of heat used for adhering the bags X and the tape T.

The clamp 92, able to move up and down, sandwiches the bags X and the tape T together with the heater 91, and is able to press the bags X against the tape T. The up and down movement of the clamp 92 is executed by the clamp air cylinder 93.

The punch/cutter unit 94 can properly punch holes and put in perforations on the tape T.

The melting prevention member 95 prevents the tape T from being melted by raising the tape T up from the heater 91, with the upward movement thereof. The up and down movement of the melting prevention member 95 is executed by the air cylinder 96.

Operation of Attaching Unit 9

The operation of the attaching unit 9 will now be described. First, in the state of the clamp 92 being moved to the top, tape T paid out from a roll 11 is placed on the heater 91. The top seal portion Z of the bag X moved to the position P2 by the grasp unit 8 is being overlapped with the tape T on the heater 91.

The tape T and the seal portion Z are sandwiched by the downward movement of the clamp 92, and the seal portion Z is being pressed against the tape T. By doing so, the seal portion Z adheres to the tape T with the heat from the heater 91. Furthermore, the region of the seal portion Z being adhered to the tape T is shown by the matching area R in FIG. 8.

The attaching unit 9 repeats the adhering of the bags X, and attaches a plurality of bags X on this strip of tape T along the longitudinal direction thereof.

The strip pack SP manufactured by a predetermined number of bags X being attached is being received at the tilted receiver 13, and guided to the discharge conveyor 6 (FIG. 2). Note that the receiver 13 is omitted in FIG. 1.

Discharge Conveyor 6

The discharge conveyor 6 discharges the strip packs SP manufactured at the strip pack apparatus 1 to a device on the downstream side. More specifically, the discharge conveyor 6 conveys the strip packs SP to the arrow c direction (FIG. 2).

Tape Feeding Unit 10

The tape feeding unit 10 pays out the tape T from the roll 11 in synchronism with the manufacturing of the strip pack SP. In addition, the roll 11 is arranged on the upper side of the body unit 2, and can be exchanged.

Control of Strip Pack Apparatus 1

Figure 9:
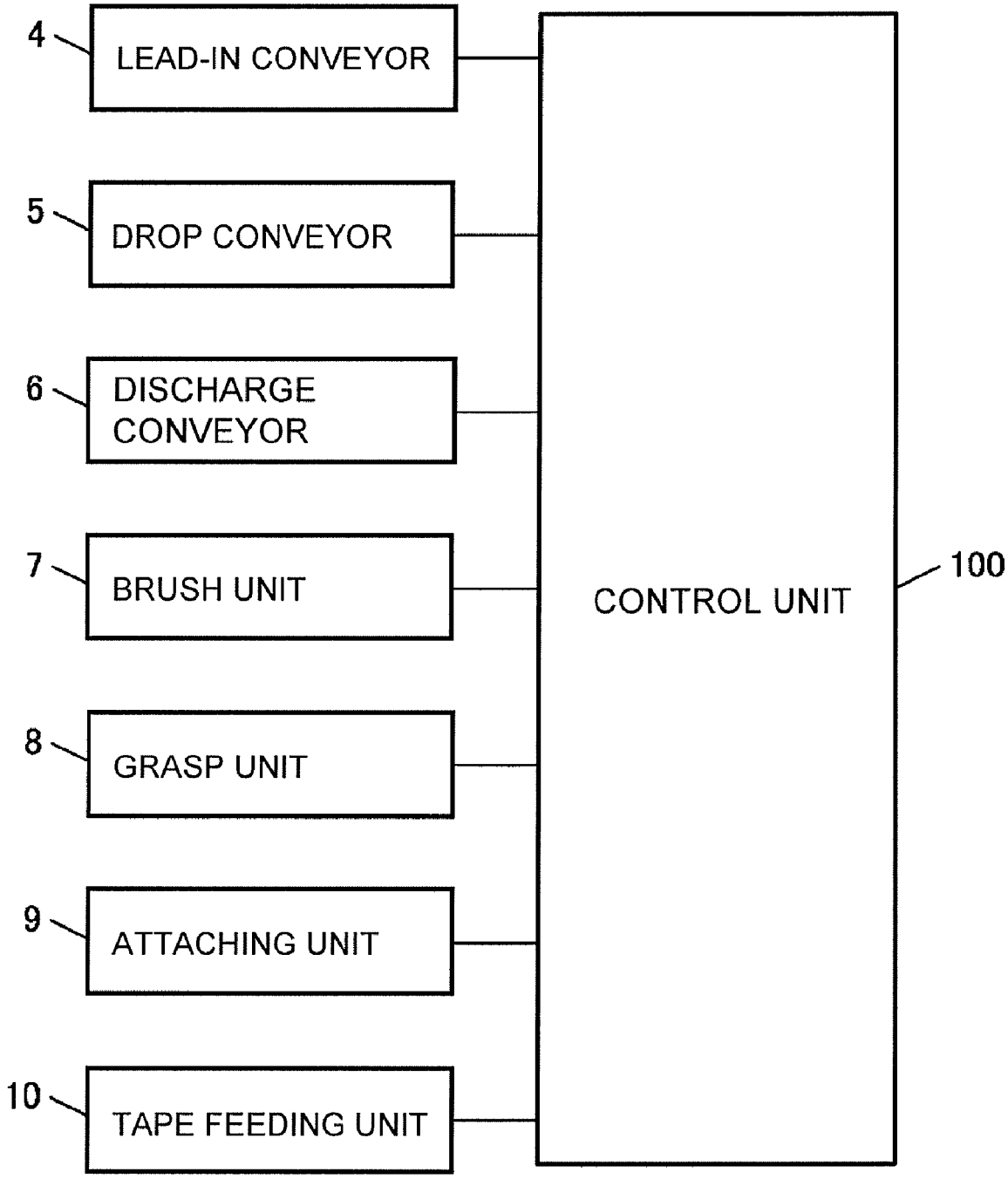
FIG. 9 is a block diagram showing a control system of the strip pack apparatus.
Figure 10:
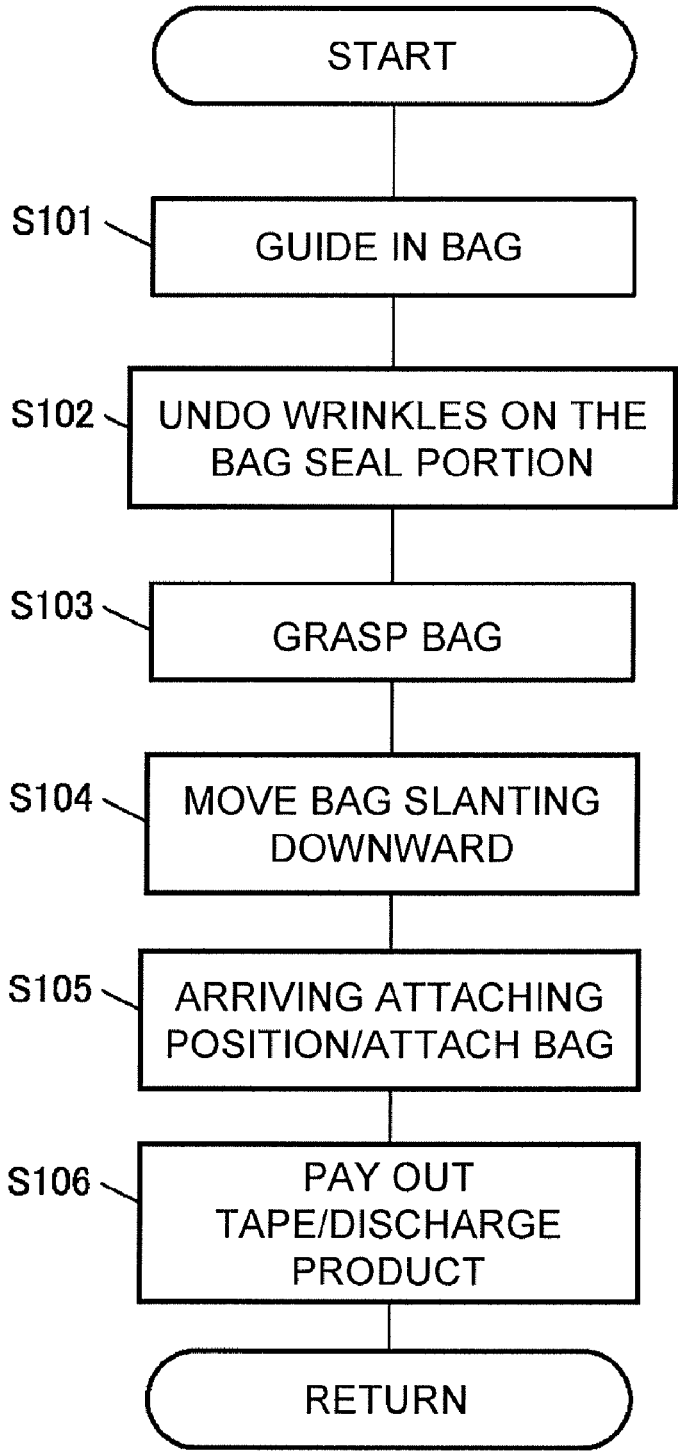
FIG. 10 is a flowchart showing the control flow of the operations of the strip pack apparatus.

FIG. 9 is a block diagram showing the connection relationship between a control unit 100 of the strip pack apparatus 1 and each of the devices. FIG. 10 is a flowchart showing the control of the strip pack apparatus 1.

As shown in FIG. 9, the control unit 100 of the strip pack apparatus 1 is connected to each of the conveyors 4 to 6, and each of the units 7 to 10, and is able to receive and send various signals. The control of the strip pack apparatus 1 through the control unit 100 will be described below using FIG. 10.

First, a bag X is guided in by the lead-in conveyor 4 to the grasp position P1 (Step S101), and dewrinkling of the seal portion Z of the bag X is performed by the brush unit 7 (Step S102). Then, the bag X is held by the grasp unit 8 (Step S103).

After that, the bag X is moved obliquely downward on the front side of the conveying direction b (Step S104). When the bag X reaches the attaching position P2, the attaching unit 9 attaches the bag X to the tape T (Step S105). Then, the tape feeding unit 10 pays out the tape T, and the strip pack SP, which is the product, is discharged (Step S106).

With the strip pack apparatus 1 described above, since the bag X conveyed by the lead-in conveyor (conveying unit) 4 is not moved directly below from the lead-in conveyor 4, but moved obliquely downward on the front side in the arrow b direction (conveying direction) from the lead-in conveyor 4, in other words, since the attaching position P2 is arranged in a position that is slanted downward on the front side in the arrow b direction away from the lead-in conveyor 4 (FIG. 4), for example, the bag X does not have to be moved up by the grasp unit (moving unit) 8 like when the attaching position P2 is arranged above the lead-in conveyor 4, and furthermore, the width of the strip pack apparatus 1 does not increase like when the attaching position P2 is arranged to the side of the lead-in conveyor 4, and also, the mechanisms and operations for moving the bag X to the attaching position P2 do not become complicated like when the attaching position P2 is arranged directly below the lead-in conveyor 4. In other words, when the bag X is moved from the lead-in conveyor 4 obliquely downward on the front side in the arrow b direction, without having to go through the trouble of removing the lead-in conveyor 4, the bag X can be moved to the attaching position P2, and as a result, the speed of the strip pack apparatus 1 can be increased.

In addition, the grasp unit 8 that moves the bags X to the attaching position P2 is not only used as the moving unit, but also used as the grasp member for holding the bags X (FIG. 4). Consequently, the configuration of the strip pack apparatus 1 is simplified. In addition, the grasp unit 8 used as the grasp member holds the seal portions Z of bags X to be attached to the tape T (FIG. 8). By doing so, the seal portions Z are kept flat. Consequently, the seal portions Z overlap with the tape T favorably, and the bags X are attached to the tape T in a favorable state.

In addition, since the drop conveyor (terminal portion of the conveying unit) 5 tilts so that the front side thereof in the arrow b direction (conveying direction) becomes lower (FIG. 4), the bag X is moved smoothly obliquely downward, and also, this prevents a great impact from acting on the bags X when they are being moved.

MODIFICATION EXAMPLE

The strip pack apparatus 1 described above is independent from both the devices on the upstream side and downstream side, but, for example, it may be integrated with the device on the upstream side or the device on the downstream side.

The seal portions Z may be held from the sides of the bags X like the pair of grip fingers 81 shown in chained line in FIGS. 5 and 8. By doing so, not only the portion near the portion being dewrinkled by the brush unit 7 can be held, but also the seal portions Z being held will not fall off easily from the pair of grip fingers 81.

This invention was described in detail, but all of the situations described above are exemplifications that are not intended for limiting this invention. It is possible to think of other examples of modifications that are not illustrated, and that do not deviate from the scope of this invention.

What is claimed is:

1. A strip pack apparatus for manufacturing a product with a plurality of items attached on a backing sheet, the strip pack apparatus comprising:

a conveying unit configured and arranged to switch between a horizontal state in which a terminal portion of the conveying unit extends generally in the horizontal direction to convey the item generally in the horizontal direction, and a tilted state in which the terminal portion of the conveying unit is tilted so that a front side of the terminal portion with respect to a conveying direction is positioned lower than a rear side of the terminal portion;

a moving unit including a grasp unit that grasps, from a front side with respect to the conveying direction, an end portion on the front side in the conveying direction of the item conveyed by the conveying unit while the item is supported by the conveying unit when the conveying unit is in the horizontal state, the moving unit being configured to move the item from the conveying unit to a position obliquely downward on the front side in the conveying direction while the end portion of the item is being grasped by the grasp unit when the conveying unit is in the tilted state; and an attaching unit configured and arranged to attach the end portion of the item grasped by the grasp to the backing sheet after the item is moved by the moving unit.

* * * * *